US009088068B2

(12) United States Patent
Choi et al.

(10) Patent No.: US 9,088,068 B2
(45) Date of Patent: Jul. 21, 2015

(54) MAGNETIC COMPOSITE SHEET AND ELECTROMAGNETIC INDUCTION MODULE

(71) Applicant: SAMSUNG ELECTRO-MECHANICS CO., LTD., Suwon (KR)

(72) Inventors: Dong Hyeok Choi, Suwon (KR); Jin Young Kim, Suwon (KR); Chang Ryul Jung, Suwon (KR); Ji Man Ryu, Suwon (KR); Sung Yong An, Suwon (KR)

(73) Assignee: SAMSUNG ELECTRO-MECHANICS CO., LTD., Suwon (KR)

( * ) Notice: Subject to any disclaimer, the term of this patent is extended or adjusted under 35 U.S.C. 154(b) by 281 days.

(21) Appl. No.: 13/888,964

(22) Filed: May 7, 2013

(65) Prior Publication Data

US 2014/0176381 A1 Jun. 26, 2014

(30) Foreign Application Priority Data

Dec. 21, 2012 (KR) ..... 10-2012-0151474

(51) Int. Cl.

| | |
|---|---|
| ***H01Q 7/08*** | (2006.01) |
| ***H01Q 7/06*** | (2006.01) |
| ***H01F 3/02*** | (2006.01) |
| ***H01F 38/14*** | (2006.01) |

(52) U.S. Cl.

CPC .. *H01Q 7/06* (2013.01); *H01F 3/02* (2013.01); *H01F 38/14* (2013.01)

(58) Field of Classification Search

USPC ..... 343/787, 788; 335/297

See application file for complete search history.

(56) References Cited

U.S. PATENT DOCUMENTS

| | | | | |
|---|---|---|---|---|
| 2005/0142387 | A1* | 6/2005 | Araki et al. | 428/694 BS |
| 2010/0259351 | A1* | 10/2010 | Bogert et al. | 336/200 |
| 2011/0159317 | A1* | 6/2011 | Tung et al. | 428/835.6 |
| 2012/0088070 | A1 | 4/2012 | Nishi | |

FOREIGN PATENT DOCUMENTS

| | | |
|---|---|---|
| JP | 11-191246 | 7/1999 |
| KR | 10-1137271 | 4/2012 |

* cited by examiner

*Primary Examiner* — Tan Ho

(57) ABSTRACT

There is provided a magnetic composite sheet including: a magnetic layer including first and second magnetic pieces having different sizes; and a cover film formed on one surface or both surfaces of the magnetic layer, wherein, in a cross-section of the magnetic composite sheet taken in a direction parallel to a direction in which the magnetic layer and the cover film are laminated, when a length of the first magnetic piece in a vertical direction is a and a length thereof in a horizontal direction is b, and a length of the second magnetic piece in the vertical direction is a' and a length thereof in the horizontal direction is b', b/a is greater than b'/a'(b/a>b'/a').

12 Claims, 5 Drawing Sheets

A-A'

MAGNETIC COMPOSITE SHEET AND ELECTROMAGNETIC INDUCTION MODULE

CROSS-REFERENCE TO RELATED APPLICATIONS

This application claims the priority of Korean Patent Application No. 10-2012-0151474 filed on Dec. 21, 2012, in the Korean Intellectual Property Office, the disclosure of which is incorporated herein by reference.

BACKGROUND OF THE INVENTION

1. Field of the Invention

The present invention relates to a magnetic composite sheet and an electromagnetic induction module capable of efficiently controlling a flow of a magnetic field.

2. Description of the Related Art

Research into a system for contactlessly transmitting power in order to charge the power in a secondary battery embedded in a portable terminal, or the like, has recently been conducted.

A contactless power transmission device generally includes a contactless power transmitter transmitting power and a contactless power receiver receiving and storing the power therein.

The contactless power transmission device transmits and receives the power using electromagnetic induction. To this end, respective interior portions of the contactless power transmitter and the contactless power receiver are provided with coils.

A contactless power receiver configured of a circuit part and a coil part may be attached to a cellular phone case or an additional accessory in a cradle to implement a function thereof.

In describing an operational principle of the contactless power transmission device, commercially available alternating current (AC) power from external power supply is input to a power supply unit of the contactless power transmitter.

The input commercially available AC power is converted into direct current (DC) power by a power conversion unit, is then again converted into an AC voltage having a specific frequency, and is then provided to the contactless power transmitter.

When the AC voltage is applied to the coil part of the contactless power transmitter, a magnetic field around the coil part changes.

As the magnetic field of the coil part of the contactless power receiver disposed to be adjacent to the contactless power transmitter changes, the coil part of the contactless power receiver outputs power to charge the secondary battery therewith.

In the contactless power transmission device, a magnetic sheet is positioned between a radio frequency (RF) antenna and a metal battery in order to increase a communications distance.

According to the related art, a flexible ferrite substrate is manufactured by allowing the ferrite sheet to have at least one continuous U or V shaped groove before being sintered and laminating a ferrite substrate between an adhesive film and a polyethylene terephthalate (PET) film after sintering the ferrite sheet.

Currently, in order to commercialize contactless power receivers, the development of a high efficiency contactless power transmission device has been demanded.

The following Related Art Document (Patent Document 1) discloses a magnetic sheet including magnetic pieces, but fails to disclose that magnetic pieces have different sizes and shapes.

RELATED ART DOCUMENT (Patent Document 1) Korean Patent No. 10-1137271

SUMMARY OF THE INVENTION

An aspect of the present invention provides a magnetic composite sheet and an electromagnetic induction module capable of efficiently controlling a flow of a magnetic field.

According to an aspect of the present invention, there is provided a magnetic composite sheet including: a magnetic layer including first and second magnetic pieces having different sizes; and a cover film formed on one surface or both surfaces of the magnetic layer, wherein, in a cross-section of the magnetic composite sheet taken in a direction parallel to a direction in which the magnetic layer and the cover film are laminated, when a length of the first magnetic piece in a vertical direction is a and a length thereof in a horizontal direction is b, and a length of the second magnetic piece in the vertical direction is a' and a length thereof in the horizontal direction is b', b/a is greater than b'/a'(b/a>b'/a').

Here, b/a may be in a range of 10 to 1000 and b'/a' may be in a range of 0.001 to 1 ($10 \le b/a \le 1000$, $0.001 \le b'/a' \le 1$).

The first and second magnetic pieces may include at least one of metal powder, metal flakes, and ferrite.

The metal power and the metal flakes may include at least one selected from a group consisting of iron (Fe), an iron-silicon (Fe—Si) alloy, an iron-silicon-aluminum (Fe—Si—Al) alloy, an iron-silicon-chromium (Fe—Si—Cr) alloy, and a nickel-iron-molybdenum (Ni—Fe—Mo) alloy.

The ferrite may include at least one of nickel-zinc-copper (Ni—Zn—Cu) and manganese-zinc (Mn—Zn).

The cover film may include polyethylene terephthalate (PTE).

According to another aspect of the present invention, there is provided an electromagnetic induction module including: a magnetic composite sheet including a magnetic layer including first and second magnetic pieces having different sizes and a cover film formed on one surface or both surfaces of the magnetic layer; and an antenna part formed on a region of the magnetic composite sheet having the first magnetic piece disposed therein, wherein, in a cross-section of the magnetic composite sheet taken in a direction parallel to a direction in which the magnetic layer and the cover film are laminated, when a length of the first magnetic piece in a vertical direction is a and a length thereof in a horizontal direction is b, and a length of the second magnetic piece in the vertical direction is a' and a length thereof in the horizontal direction is b', b/a is greater than b'/a'(b/a>b'/a').

Here, b/a may be in a range of 10 to 1000 and b'/a' may be in a range of 0.001 to 1 ($10 \le b/a \le 1000$, $0.001 \le b'/a' \le 1$).

The first and second magnetic pieces may include at least one of metal powder, metal flakes, and ferrite.

The metal powder and the metal flakes may include at least one selected from a group consisting of iron (Fe), an iron-silicon (Fe—Si) alloy, an iron-silicon-aluminum (Fe—Si—Al) alloy, an iron-silicon-chromium (Fe—Si—Cr) alloy, and a nickel-iron-molybdenum (Ni—Fe—Mo) alloy.

The ferrite may include at least one of nickel-zinc-copper (Ni—Zn—Cu) and manganese-zinc (Mn—Zn).

The cover film may include polyethylene terephthalate (PTE).

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
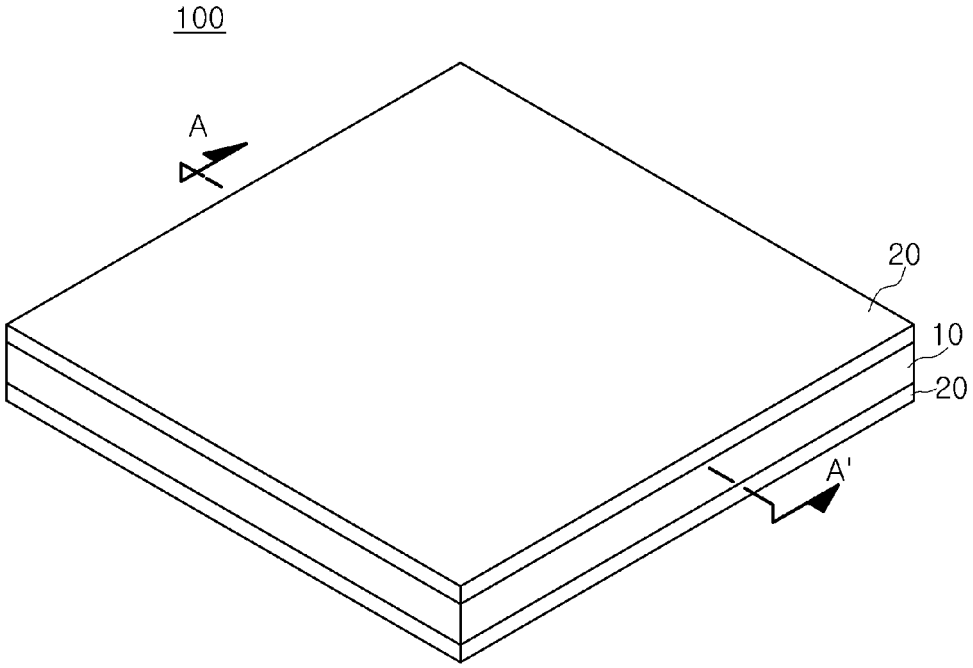
FIG. 1 is a perspective view schematically showing a magnetic composite sheet according to an embodiment of the present invention.

Hereinafter, embodiments of the present invention will be described in detail with reference to the accompanying drawings.

The invention may, however, be embodied in many different forms and should not be construed as being limited to the embodiments set forth herein. Rather, these embodiments are provided so that this disclosure will be thorough and complete, and will fully convey the scope of the invention to those skilled in the art.

In the drawings, the shapes and dimensions of components may be exaggerated for clarity, and the same reference numerals will be used throughout to designate the same or like components.

Meanwhile, in describing the embodiments of the present invention, a wireless charging component generally includes a wireless power transmitter transmitting power and a wireless power receiver receiving and storing the power therein.

Magnetic Composite Sheet

Figure 2:
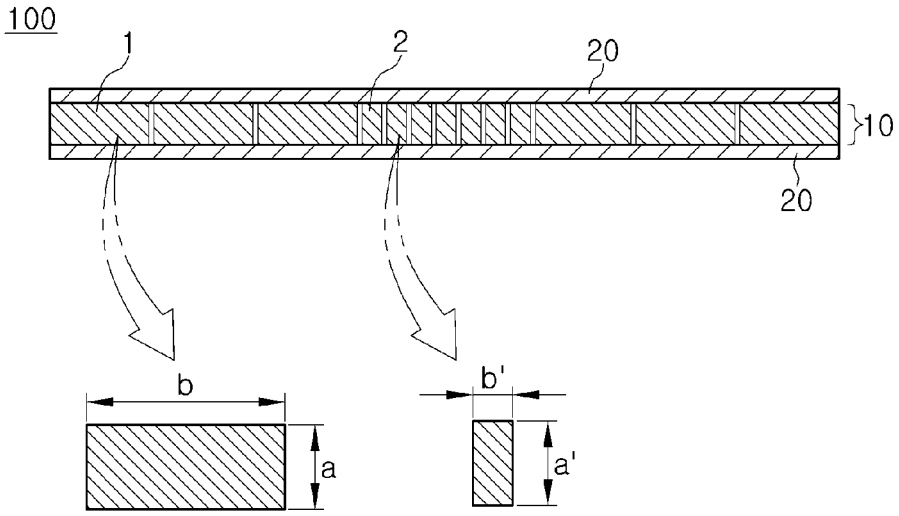
FIG. 2 is a cross-sectional view taken along line A-A' of FIG. 1.

FIG. 1 is a perspective view schematically showing a magnetic composite sheet 100 according to an embodiment of the present invention, and FIG. 2 is a cross-sectional view taken along line A-A' of FIG. 1.

Referring to FIGS. 1 and 2, the magnetic composite sheet 100 may include a magnetic layer 10, and a cover film 20, and the magnetic layer may include first magnetic pieces 1 and second magnetic pieces 2 that have different sizes from each other.

The magnetic layer 10 may be formed of slurry including magnetic powder, a solvent, and a binder. The magnetic powder may contain at least one of metal powder, metal flakes, or ferrite.

The metal powder and metal flakes may include at least one selected from a group consisting of iron (Fe), an iron-silicon (Fe—Si) alloy, an iron-silicon-aluminum Fe—Si—Al) alloy, an iron-silicon-chromium (Fe—Si—Cr) alloy, and a nickel-iron-molybdenum (Ni—Fe—Mo) alloy, but are not limited thereto.

The ferrite may include at least one of nickel-zinc-copper (Ni—Zn—Cu) and manganese-zinc (Mn—Zn), but is not limited thereto.

For example, the ferrite may be $(NiCuZn)Fe_2O$.

The slurry may be prepared by adding the solvent and the binder to the magnetic powder. The slurry may further include a dispersant so as to allow the components contained in the slurry to be uniformly dispersed.

The slurry may be prepared using a ball mill, but is not limited thereto. First, after the magnetic powder, the solvent, and the dispersant are mixed with each other, individual components may be uniformly dispersed using the ball mill for 10 hours. Then, the binder is additionally input thereto, and additionally mixed for about 4 hours. The reason of performing the mixing and dispersing process in two operations is that in the case in which the binder is initially added, it may be difficult to uniformly disperse the magnetic powder in the slurry due to viscosity of the binder.

The solvent may include at least one of toluene, alcohol, and methyl ethyl ketone (MEK), but is not limited thereto.

The binder may be at least one selected from a group consisting of water glass, polyimide, polyamide, silicon, a phenolic resin, and acrylic material, but is not limited thereto.

In the case in which insulating properties are required, ceramic powder may be added to the slurry. The ceramic powder may include kaolin, talc, or the like. Any ceramic powder may be used as long as the powder has electrical insulating properties.

Next, a green sheet may be manufactured by forming the slurry as a thin sheet and heating the sheet.

As a method of forming the slurry as the sheet, a tape casting method, a doctor blade method, or the like, may be used, but the present invention is not limited thereto.

The green sheet may refer to a sheet in a state in which the sheet is thermally treated at a relatively low temperature of 50° C. to 100° C. and is not sintered, and the solvent is removed.

A green sheet laminate body having a desired thickness may be obtained by laminating the green sheets while applying pressure. In the case of making the laminate body thin, the green sheet laminate body may be configured of a single green sheet.

Next, grooves having a predetermine depth may be formed in the green sheet laminate body in a lamination direction. In other words, the grooves may be formed to have a depth shallow enough not to penetrate through the green sheet laminate body. A process of forming the grooves is intended to obtain the first and second pieces having the desired sizes and needs to be performed in consideration of a shrinkage ratio after firing.

Then, the green sheet laminate body including the grooves formed therein may be plasticized and sintered, thereby preparing a magnetic sintered body. The cover film 20 may be attached to both surfaces of the magnetic sintered body or one surface thereof.

The cover film 20 may include an organic resin having flexibility, for example, polyethylene terephthalate (PTE), but is not limited thereto.

A process of fracturing the magnetic sintered body in which the magnetic sintered body is separated into the plurality of magnetic pieces 1 and 2 along the grooves may be performed after attaching the cover film 20, thereby obtaining the magnetic composite sheet. The process of fracturing the magnetic sintered body may be performed by bending the magnetic sintered body including the cover film attached thereto, and this bending operation may be performed using a roller.

The magnetic pieces forming the magnetic layer 10 of the magnetic composite sheet 100 formed by the above-mentioned processes may include the first and second magnetic pieces 1 and 2 having different sizes. In the case of magnetic materials, different properties may be exhibited according to their geometrical shapes as well as magnetic properties of the material itself. More specifically, as a length of the magnetic material in a direction horizontal to a magnetic field direction thereof becomes longer than that in a direction perpendicular to the magnetic field direction, a demagnetizing factor is decreased. In other words, magnetic force may more easily flow in a long axial direction of the magnetic material. Therefore, in the case of using shape anisotropy as described above, efficiency of the magnetic composite sheet used as a magnetic absorbent may be improved.

Therefore, in the present invention, in order to significantly decrease demagnetizing field and to significantly increase the shape magnetic anisotropy of the magnetic composite sheet, the first and second magnetic pieces 1 and 2 of which shapes are controlled may be included. More specifically, as shown in FIG. 2, in a cross-section of the magnetic composite sheet taken in a direction parallel to a direction in which the magnetic layer and the cover film are laminated, when a length of the first magnetic piece 1 in a vertical direction is a, and a length thereof in a horizontal direction is b, and a length of the second magnetic piece 2 in a vertical direction is a' and a length thereof in a horizontal direction is b', b/a may be greater than b'/a' ($b/a>b'/a'$).

The vertical direction refers to a direction parallel to the direction in which the magnetic layer 10 and cover film 20 are laminated, and the horizontal direction refers to a direction perpendicular to the direction in which the magnetic layer 10 and cover film 20 are laminated.

The magnetic composite sheet 100 according to the embodiment of the present invention may include two types of magnetic pieces of which ratios between the length in the horizontal direction and the length in the vertical direction are different from each other, thereby facilitating the control of the flow of the magnetic field.

More specifically, b/a may be in a range of 10 to 1000, and b'/a' may be in a range of 0.001 to 1 ($10\leq b/a\leq 1000$, $0.001\leq b'/a'\leq 1$). The first magnetic piece 1 is to facilitate the flow of the magnetic field in the horizontal direction, and the second magnetic piece 2 is to facilitate the flow of the magnetic field in the vertical direction.

In the case in which b/a of the first magnetic piece is less than 10, there is no effect of improving a magnetic flux flow in the horizontal direction, and in the case in which b/a is greater than 1000, an effect of controlling the magnetic flux flow is not increased any further, and the length of the piece in the horizontal direction is excessively long such that flexibility of the magnetic composite sheet may be decreased.

Further, in the case of the second magnetic piece, when b'/a' is greater than 1, there is no effect of improving the magnetic flux flow in the vertical direction, and when b'/a' is less than 0.001, an effect of controlling the magnetic flux flow is not increased any further and it may be difficult to manufacture the second magnetic piece.

Numerical values with respect to b/a and b'/a' will be described in detail based on results of wireless charging efficiency in Experimental Examples to be described below.

In addition, in the magnetic composite sheet 100 according to the embodiment of the present invention, the first and second magnetic pieces 1 and 2 may not be separated independently due to the flexible cover film 20 but be attached to a surface of the cover film 20, and the magnetic layer 10 may be configured of the plurality of pieces 1 and 2 to have flexibility.

Further, the magnetic composite sheet 100 may be differently configured by allowing an adhesive flexible cover film to be disposed on one surface of the magnetic layer 10, and allowing a flexible protective film to be disposed on the other surface thereof.

Electromagnetic Induction Module

Figure 3:
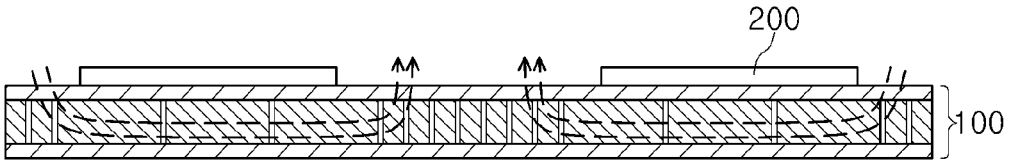
FIG. 3 is a cross-sectional view showing an electromagnetic induction module according to an embodiment of the present invention.

FIG. 3 is a cross-sectional view showing an electromagnetic induction module according to an embodiment of the present invention.

The electromagnetic induction module may include a magnetic composite sheet 100 and an antenna part 200.

A description of contents of the electromagnetic induction module that are overlapped with those of the above-mentioned magnetic composite sheet will be omitted.

The antenna part 200 may be a device transmitting or receiving electromagnetic force and formed of a coil, but is not limited thereto.

The antenna part 200 may include a single coil formed in a wiring pattern form or a single coil pattern formed by connecting a plurality of coil strands in parallel to one another.

In the case in which the antenna part 200 is formed of a coil pattern, a magnetic path may be formed in the coil pattern.

The antenna part 200 may be manufactured to have a winding form or a flexible film form, but is not limited thereto.

The antenna part 200 may transmit input power using an induced magnetic field or receive the induced magnetic field to allow the power to be output, thereby enabling contactless power transmission and reception.

Arrows shown in FIG. 3 indicate the magnetic path formed by the antenna part. In the electromagnetic induction module, the magnetic composite sheet 100 should serve to block a magnetic field and simultaneously amplify a distance of transmission and reception. In order to block the magnetic field, a flow of the magnetic field below the antenna part 200 needs to be controlled so that the flow is in parallel to the magnetic composite sheet 100, and in order to amplify the distance of transmission and reception, a flow of magnetic field in a region in which the antenna part 200 is not present needs to be activated in a direction perpendicular to the magnetic composite sheet 100.

Since the magnetic path is formed in the direction parallel to the magnetic composite sheet below the antenna part, the antenna part 200 may be disposed on a region of the magnetic composite sheet 100 in which first magnetic pieces 1 are disposed. In addition, since the magnetic path is formed in the direction perpendicular to the magnetic composite sheet 100 in the region of the magnetic composite sheet 100 in which the antenna part 200 is not present, second magnetic pieces 2 need to be disposed in the region in which the antenna part 200 is not present in order to amplify the distance of transmission and reception.

According to the embodiment of the present invention, shapes of the magnetic pieces included in the magnetic layer configuring the magnetic composite sheet may be controlled, such that the magnetic field generated by the antenna part may be efficiently blocked and the distance of transmission and reception may be increased, thereby improving charging efficiency when this electromagnetic induction module is used in a wireless power transmission and reception device.

Wireless Power Transmission and Reception Device

Figure 4:
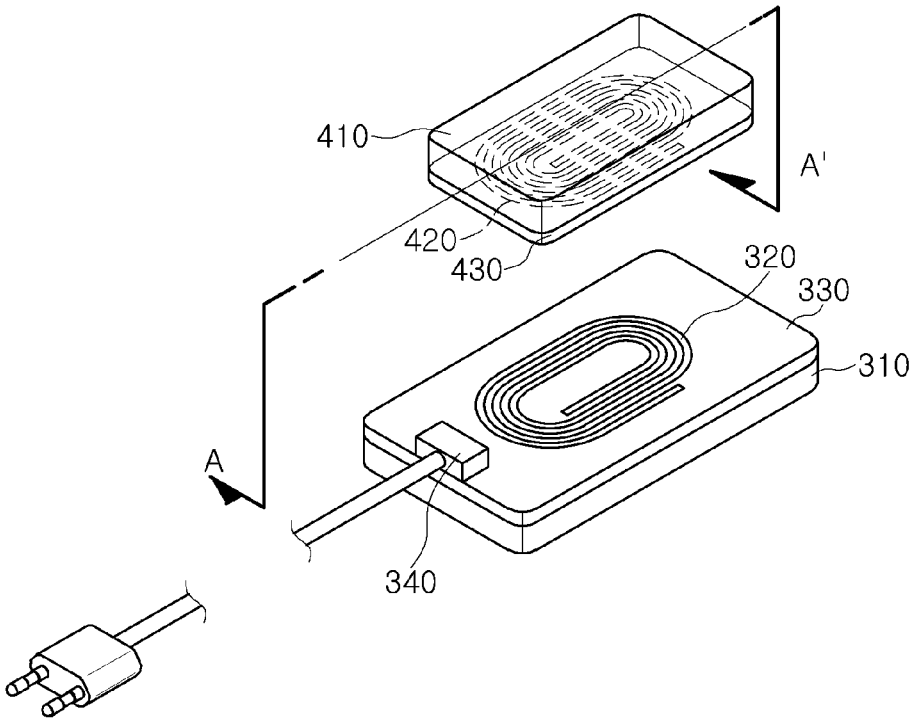
FIG. 4 is a perspective view schematically showing a wireless charging device configured of a receiver and transmitter.
Figure 5:
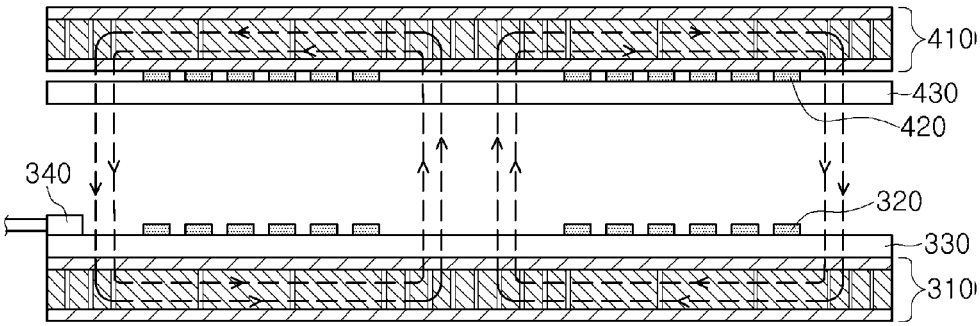
FIG. 5 is a cross-sectional view taken along line A-A' of FIG. 4.

FIG. 4 is a perspective view schematically showing a wireless power transmission and reception device configured of a receiver and a transmitter, and FIG. 5 is a cross-sectional view taken along line A-A' of FIG. 4.

Referring to FIGS. 4 and 5, the wireless power transmission and reception device may include a wireless power transmitter including a power supply part 340 to which AC power is input, a transmission antenna part 320 generating a magnetic field change according to AC voltage from the power supply part 340, and a transmitter magnetic composite sheet 310 disposed under the transmission antenna part 320; and a wireless power receiver including a reception antenna part 420 outputting power according to the magnetic field change generated from the transmission antenna part and a receiver magnetic composite sheet 410 disposed above the reception antenna part.

Further, in order to facilitate formation of the transmission and reception antenna parts, an upper or lower portion of the antenna part may be additionally provided with a support layer 430 or 330.

Regions of the transmitter and receiver magnetic composite sheets 310 and 410 corresponding to the antenna parts 320 and 420 include first magnetic pieces disposed therein, and regions of the transmitter and receiver magnetic composite sheets 310 and 410 having no antenna part formed thereon include second magnetic pieces disposed therein, similarly to the above-mentioned electromagnetic induction module.

Electronic Component Including Wireless Power Charging Device

Figure 6:
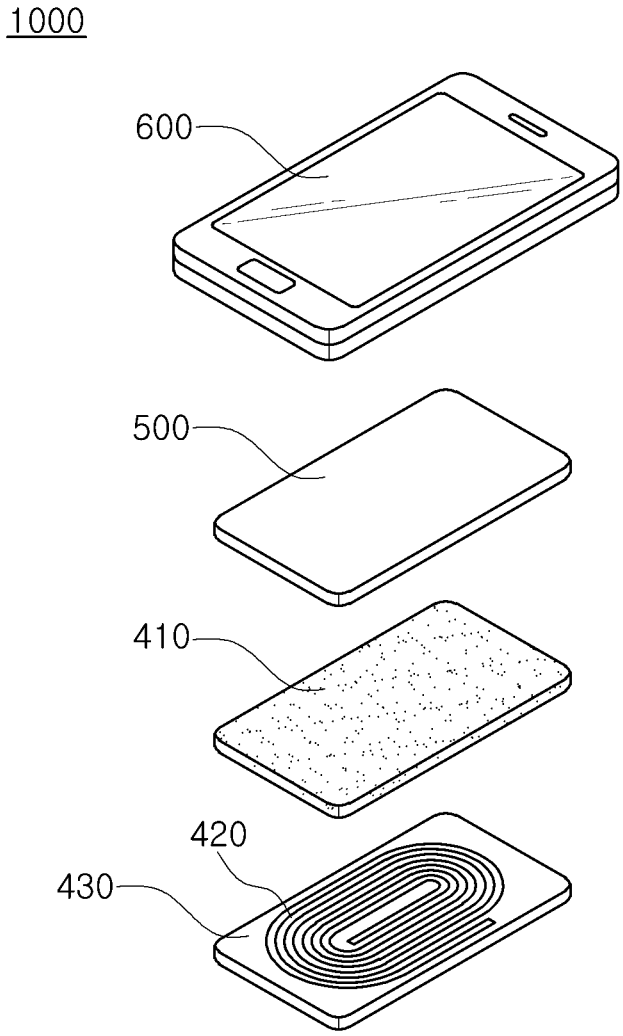
FIG. 6 is an exploded perspective view of an electronic component including a wireless charging receiver.

FIG. 6 is an exploded perspective view of an electronic component including a wireless power receiver.

Figure 7:
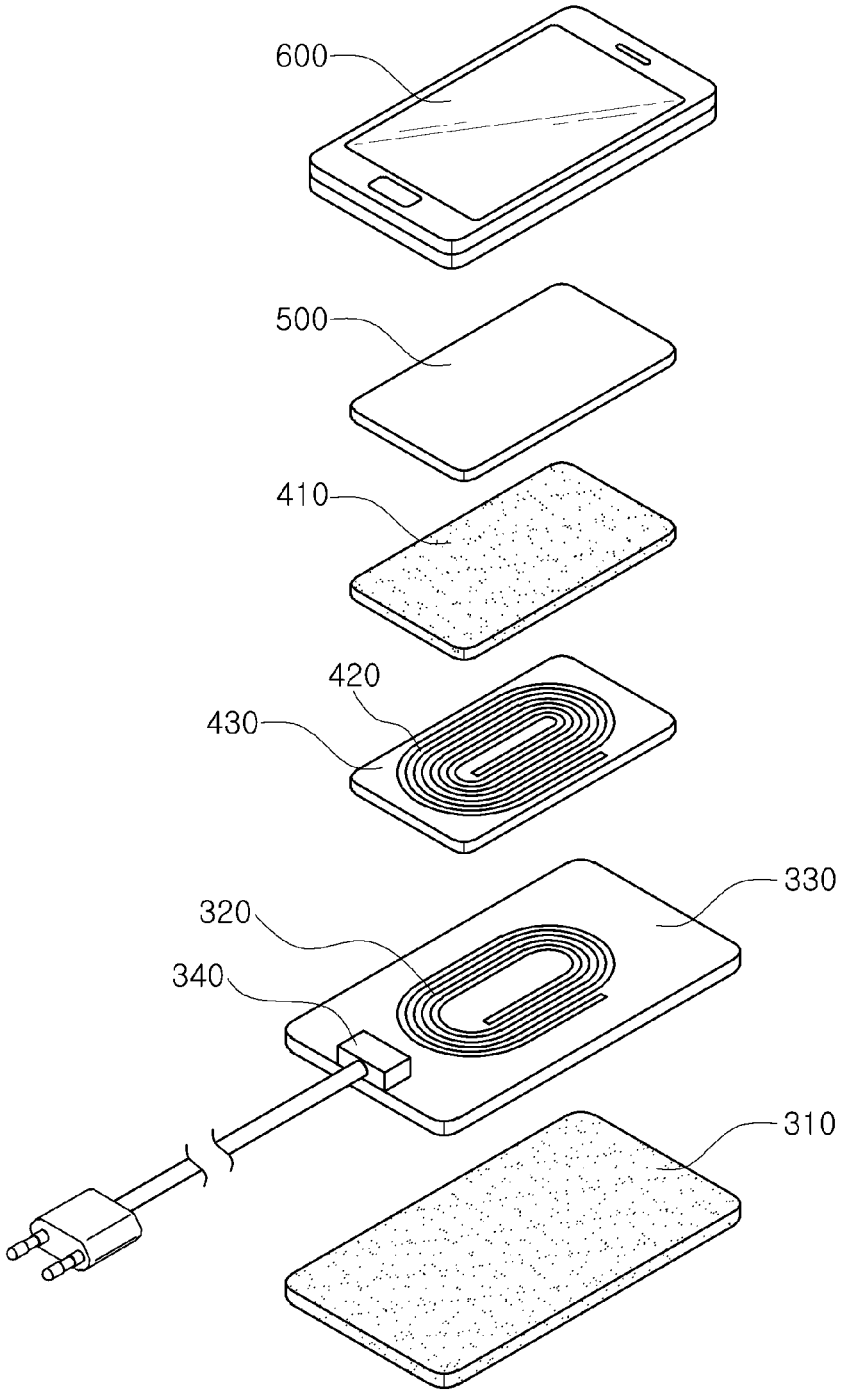
FIG. 7 is an exploded perspective view of an electronic component including a wireless charging receiver, and a wireless charging transmitter.

FIG. 7 is an exploded perspective view of an electronic component including a wireless power receiver, and a wireless power transmitter.

As shown in FIGS. 6 and 7, the electronic component having a wireless power receiver may include an electric device body part 600, a power storage part 500, a receiver magnetic composite sheet 410, and a reception antenna part 420.

In addition, the electronic component having a wireless power receiver may be wirelessly charged with power by the wireless power transmitter as shown in FIG. 7.

The antenna part 320 of the wireless power transmitter may generate a magnetic field change according to AC voltage from a power supply part 340, and a magnetic composite sheet 310 disposed in a lower portion of the transmitter may block the magnetic field from being leaked and simultaneously amplify a flow of the magnetic field toward the receiver.

In the wireless power receiver, the reception antenna part 420 may receive the magnetic field change generated by the wireless power transmitter to output power. The output power may be stored in the power storage part 500, wherein the power storage part may be a secondary battery, but is not limited thereto.

Since the shapes and dispositions of the antenna parts 320 and 420 and the magnetic composite sheets 310 and 410 included in the wireless power transmitter and receiver are overlapped with those of the above-mentioned electromagnetic induction module, a description thereof will be omitted.

Experimental Examples

In a cross-section of a magnetic composite sheet taken in a direction parallel to a direction in which a magnetic layer and a cover film are laminated, when a length of a first magnetic piece in a vertical direction is a, and a length thereof in a horizontal direction is b, and a length of a second magnetic piece in a vertical direction is a' and a length thereof in a horizontal direction is b', the following Table 1 shows charging efficiency of a wireless power charging device including the magnetic composite sheet according to change in b/a and b'/a'.

TABLE 1

| Experimental Examples | b/a | b'/a' | Charging Efficiency (%) |
|---|---|---|---|
| 1* | 1 | 10 | 67.8 |
| 2* | 1 | 2 | 67.8 |
| 3* | 1 | 1 | 67.8 |
| 4* | 1 | 0.1 | 67.9 |
| 5* | 1 | 0.01 | 67.9 |
| 6* | 1 | 0.001 | 67.9 |
| 7* | 1 | 0.0008 | 67.8 |
| 8* | 1 | 0.0001 | 67.9 |
| 9* | 8 | 10 | 67.8 |
| 10* | 8 | 2 | 67.8 |
| 11* | 8 | 1 | 67.9 |
| 12* | 8 | 0.1 | 67.9 |
| 13* | 8 | 0.01 | 67.9 |
| 14* | 8 | 0.001 | 67.9 |
| 15* | 8 | 0.0008 | 67.9 |
| 16* | 8 | 0.0001 | 67.9 |
| 17* | 10 | 10 | 67.8 |
| 18* | 10 | 2 | 67.9 |
| 19 | 10 | 1 | 68.1 |
| 20 | 10 | 0.1 | 68.6 |
| 21 | 10 | 0.01 | 69.0 |
| 22 | 10 | 0.001 | 69.3 |
| 23* | 10 | 0.0008 | 69.3 |
| 24* | 10 | 0.0001 | 69.3 |
| 25* | 100 | 10 | 67.9 |
| 26* | 100 | 2 | 67.9 |
| 27 | 100 | 1 | 68.3 |
| 28 | 100 | 0.1 | 68.6 |
| 29 | 100 | 0.01 | 68.8 |
| 30 | 100 | 0.001 | 68.9 |
| 31* | 100 | 0.0008 | 68.9 |
| 32* | 100 | 0.0001 | 68.9 |
| 33* | 1000 | 10 | 67.9 |
| 34* | 1000 | 2 | 67.9 |
| 35 | 1000 | 1 | 68.3 |
| 36 | 1000 | 0.1 | 68.7 |
| 37 | 1000 | 0.01 | 69.0 |
| 38 | 1000 | 0.001 | 69.2 |
| 39* | 1000 | 0.0008 | 69.2 |
| 40* | 1000 | 0.0001 | 69.2 |
| 41* | 2000 | 10 | 67.9 |
| 42* | 2000 | 2 | 67.9 |
| 43 | 2000 | 1 | 68.3 |
| 44 | 2000 | 0.1 | 68.7 |
| 45 | 2000 | 0.01 | 68.9 |
| 46 | 2000 | 0.001 | 69.2 |
| 47* | 2000 | 0.0008 | 69.2 |
| 48* | 2000 | 0.0001 | 69.2 |
| 49* | 10000 | 10 | 67.9 |
| 50* | 10000 | 2 | 67.9 |
| 51 | 10000 | 1 | 68.3 |
| 52 | 10000 | 0.1 | 68.8 |
| 53 | 10000 | 0.01 | 69.0 |
| 54 | 10000 | 0.001 | 69.2 |
| 55* | 10000 | 0.0008 | 69.1 |
| 56* | 10000 | 0.0001 | 69.2 |

*indicates a Comparative Example.

As shown in Table 1, in the case in which b/a was less than 10, it was not easy to control a flow of a magnetic field in the horizontal direction, and in the case in which b'/a' was greater than 1, it was not easy to control a flow of the magnetic field in the vertical direction, such that the wireless charging efficiency was not improved. That is, the charging efficiency was less than 68% similarly to the case of using a magnetic composite sheet configured of magnetic pieces having the same size.

Further, in the case in which b/a is greater than 10 and b'/a' is less than 1, the wireless charging efficiency was increased, but in the case in which b/a is greater than 1000 or b'/a' is less than 0.001, the charging efficiency was hardly increased, and it may be difficult to manufacture the magnetic composite sheet. Therefore, it may be confirmed that b/a is in a critical range of 10 to 1000 and b'/a' is in a critical range of 0.001 to 1 ($10 \le b/a \le 1000$, $0.001 \le b'/a' \le 1$), the charging efficiency is increased.

As set forth above, according to the embodiments of the present invention, the magnetic composite sheet and the electromagnetic induction module may efficiently control the flow of the magnetic field and improve power transmission and reception efficiency when the magnetic composite sheet and the electromagnetic induction module are used in the wireless power transmission and reception device.

While the present invention has been shown and described in connection with the embodiments, it will be apparent to those skilled in the art that modifications and variations can be made without departing from the spirit and scope of the invention as defined by the appended claims.

What is claimed is:

1. A magnetic composite sheet comprising:

a magnetic layer including first and second magnetic pieces having different sizes; and a cover film formed on one surface or both surfaces of the magnetic layer, wherein, in a cross-section of the magnetic composite sheet taken in a direction parallel to a direction in which the magnetic layer and the cover film are laminated, when a length of the first magnetic piece in a vertical direction is a and a length thereof in a horizontal direction is b, and a length of the second magnetic piece in the vertical direction is a' and a length thereof in the horizontal direction is b', b/a is greater than b'/a'(b/a>b'/a').

2. The magnetic composite sheet of claim 1, wherein b/a is in a range of 10 to 1000 and b'/a' is in a range of 0.001 to 1 ($10 \le b/a \le 1000$, $0.001 \le b'/a' \le 1$).

3. The magnetic composite sheet of claim 1, wherein the first and second magnetic pieces include at least one of metal powder, metal flakes, and ferrite.

4. The magnetic composite sheet of claim 3, wherein the metal powder and the metal flakes include at least one selected from a group consisting of iron (Fe), an iron-silicon (Fe—Si) alloy, an iron-silicon-aluminum (Fe—Si—Al) alloy, an iron-silicon-chromium (Fe—Si—Cr) alloy, and a nickel-iron-molybdenum (Ni—Fe—Mo) alloy.

5. The magnetic composite sheet of claim 3, wherein the ferrite includes at least one of nickel-zinc-copper (Ni—Zn—Cu) and manganese-zinc (Mn—Zn).

6. The magnetic composite film of claim 1, wherein the cover film includes polyethylene terephthalate (PET).

7. An electromagnetic induction module comprising:

a magnetic composite sheet including a magnetic layer including first and second magnetic pieces having different sizes and a cover film formed on one surface or both surfaces of the magnetic layer; and an antenna part formed on a region of the magnetic composite sheet having the first magnetic piece disposed therein, wherein, in a cross-section of the magnetic composite sheet taken in a direction parallel to a direction in which the magnetic layer and the cover film are laminated, when a length of the first magnetic piece in a vertical direction is a and a length thereof in a horizontal direction is b, and a length of the second magnetic piece in the vertical direction is a' and a length thereof in the horizontal direction is b', b/a is greater than b'/a'(b/a>b'/a').

8. The electromagnetic induction module of claim 7, wherein b/a is in a range of 10 to 1000 and b'/a' is in a range of 0.001 to 1 ($10 \le b/a \le 1000$, $0.001 \le b'/a' \le 1$).

9. The electromagnetic induction module of claim 7, wherein the first and second magnetic pieces include at least one of metal powder, metal flakes, and ferrite.

10. The electromagnetic induction module of claim 9, wherein the metal powder and the metal flakes include at least one selected from a group consisting of iron (Fe), an iron-silicon (Fe—Si) alloy, an iron-silicon-aluminum (Fe—Si—Al) alloy, an iron-silicon-chromium (Fe—Si—Cr) alloy, and a nickel-iron-molybdenum (Ni—Fe—Mo) alloy.

11. The electromagnetic induction module of claim 9, wherein the ferrite includes at least one of nickel-zinc-copper (Ni—Zn—Cu) and manganese-zinc (Mn—Zn).

12. The electromagnetic induction module of claim 7, wherein the cover film includes polyethylene terephthalate (PET).

* * * * *